US007503096B2

(12) United States Patent
Lin

(10) Patent No.: US 7,503,096 B2
(45) Date of Patent: Mar. 17, 2009

(54) DUST-COLLECTABLE MOBILE ROBOTIC VACUUM CLEANER

(75) Inventor: Wen-Hsu Lin, Taichung County (TW)

(73) Assignee: E-Supply International Co., Ltd., Taichung (TW)

( * ) Notice: Subject to any disclaimer, the term of this patent is extended or adjusted under 35 U.S.C. 154(b) by 129 days.

(21) Appl. No.: 11/486,275

(22) Filed: Jul. 14, 2006

(65) Prior Publication Data

US 2007/0143950 A1 Jun. 28, 2007

(30) Foreign Application Priority Data

Dec. 27, 2005 (TW) ..... 94222773 U

(51) Int. Cl.
*A47L 5/00* (2006.01)

(52) U.S. Cl. ..... 15/319; 15/355; 15/359; 15/372; 15/418

(58) Field of Classification Search ..... 15/319, 15/355, 359, 372, 418
See application file for complete search history.

(56) References Cited

U.S. PATENT DOCUMENTS 6,099,661 A * 8/2000 Conrad ..... 134/21
6,748,297 B2 * 6/2004 Song et al. ..... 700/259
6,883,201 B2 4/2005 Jones et al.

* cited by examiner

*Primary Examiner*—Joseph J. Hail, III
*Assistant Examiner*—Shantese L McDonald
(74) *Attorney, Agent, or Firm*—Bacon & Thomas, PLLC

(57) ABSTRACT

A dust-collectable mobile robotic vacuum cleaner includes a base frame, a driving device mounted to the base frame, a control device mounted to the base frame and electrically connected with the driving device, a collision-detectable unit mounted to the base frame electrically connected with the control device, and a dust-collecting device mounted to the base frame. The dust-collecting device has dust-collecting box, a dust guider, a round brush, and a dust entrance formed at one side of the dust-collecting box. The dust guider is located at a lower edge of the dust entrance, having two opposite sides pivotably mounted to the dust-collecting box and lying against the ground at a predetermined angle respectively, for upward and downward pivoting movement. The round brush is rotatably located at a front end of the dust guider for sweeping dust particles.

7 Claims, 7 Drawing Sheets

DUST-COLLECTABLE MOBILE ROBOTIC VACUUM CLEANER

BACKGROUND OF THE INVENTION

1. Field of the Invention

The present invention relates generally to mobile robotic vacuum cleaners, and more particularly, to a dust-collectable mobile robotic vacuum cleaner.

2. Description of the Related Art

As disclosed in U.S. Pat. No. 6,883,201, an antonymous floor-cleaning robot is composed of a brush assembly, a vacuum system, and a dust-collecting box, for sweeping and collecting dust particles. The brush assembly includes two round brushes parallel to each other. While the antonymous floor-cleaning robot is operated, the two round brushes roll in counter-direction to capture the dust particles away from the ground and then the vacuum system sucks the dust particles into the dust-collecting box.

However, as shown in FIG. 7, a dead angle 2 is formed among the two round brushes 1 and the ground. While doing cleaning operation, the antonymous floor-cleaning robot fails to clean the dust particles located at the dead angle 2. Thus, the conventional antonymous floor-cleaning robot is defective to require further improvement.

SUMMARY OF THE INVENTION

The primary objective of the present invention is to provide a dust-collectable mobile robotic vacuum cleaner, which can effectively clean the dust particles.

The foregoing objectives of the present invention are attained by the dust-collectable mobile robotic vacuum cleaner, which is composed of a base frame, a driving device mounted to the base frame, a control device mounted to the base frame and electrically connected with the driving device, a collision-detectable unit mounted to the base frame electrically connected with the control device, and a dust-collecting device mounted to the base frame. The dust-collecting device includes dust-collecting box, a dust guider, a round brush, and a dust entrance formed at one side of the dust-collecting box. The dust guider is located at a lower edge of the dust entrance, having two opposite sides pivotably mounted to the dust-collecting box and lying against the ground at a predetermined angle respectively, for upward and downward pivoting movement. The round brush is rotatably located at a front end of the dust guider for sweeping dust particles. In light of this, when the robotic vacuum cleaner is operated to clean the dust, the round brush lies against the ground and inwardly rotatably sweeps the dust particles to enable the dust particles to be captured along the dust guider through the dust entrance into the dust-collecting box.

Further, the dust guider includes a plurality of guiding portions and two bevels formed at two sides of a front end thereof respectively. While turning and encountering a barrier, the robotic vacuum cleaner can slidably move over and across the barrier by means of the bevels. While moving forward and encountering the barrier, the robotic vacuum cleaner can slidably move over and across the barrier by means of the guiding portion. Accordingly, the present invention can effective clean the dust particles.

DETAILED DESCRIPTION OF PREFERRED EMBODIMENTS

Figure 1:
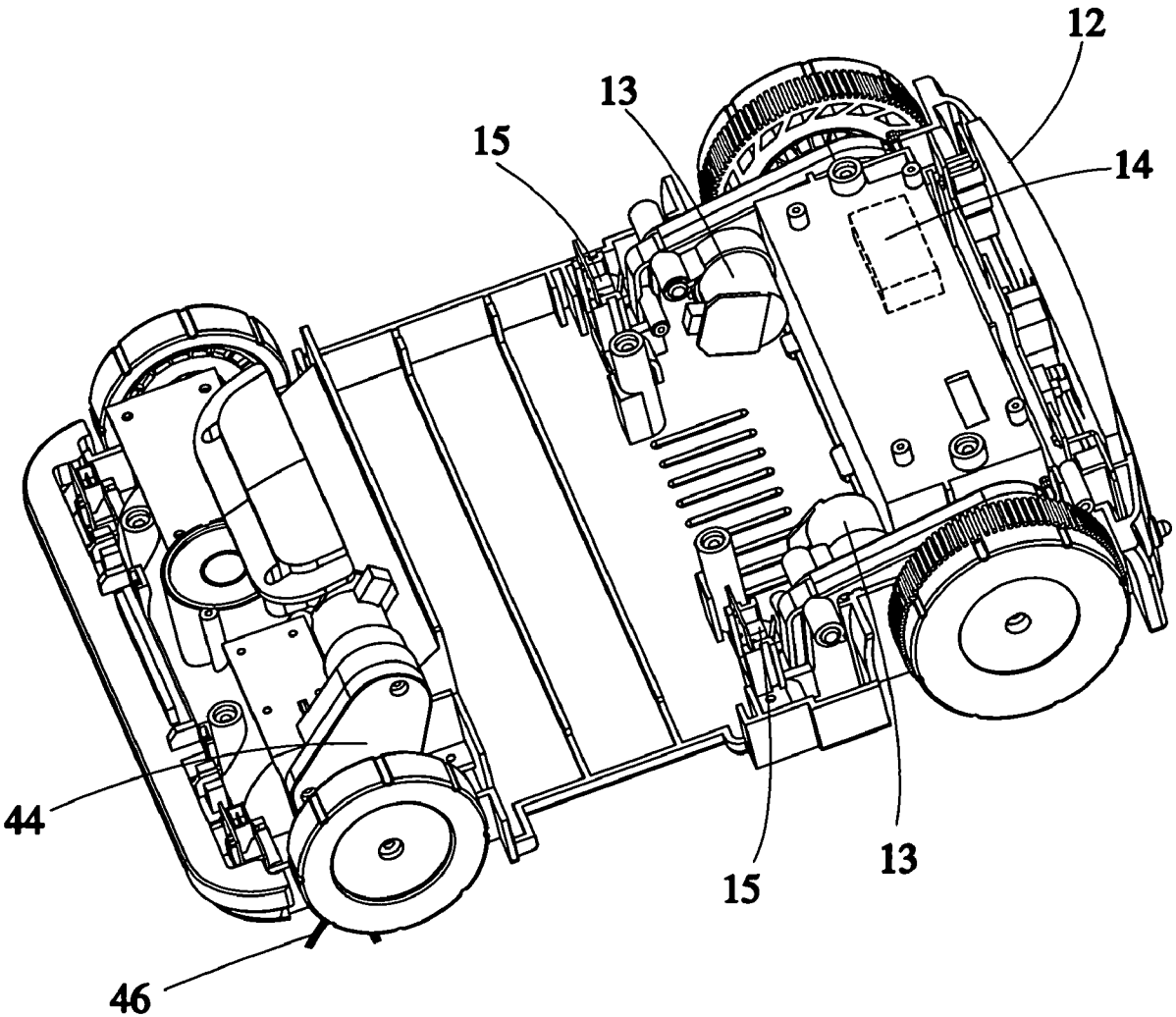
FIG. 1 is a perspective view of a part of a preferred embodiment of the present invention.
Figure 2:
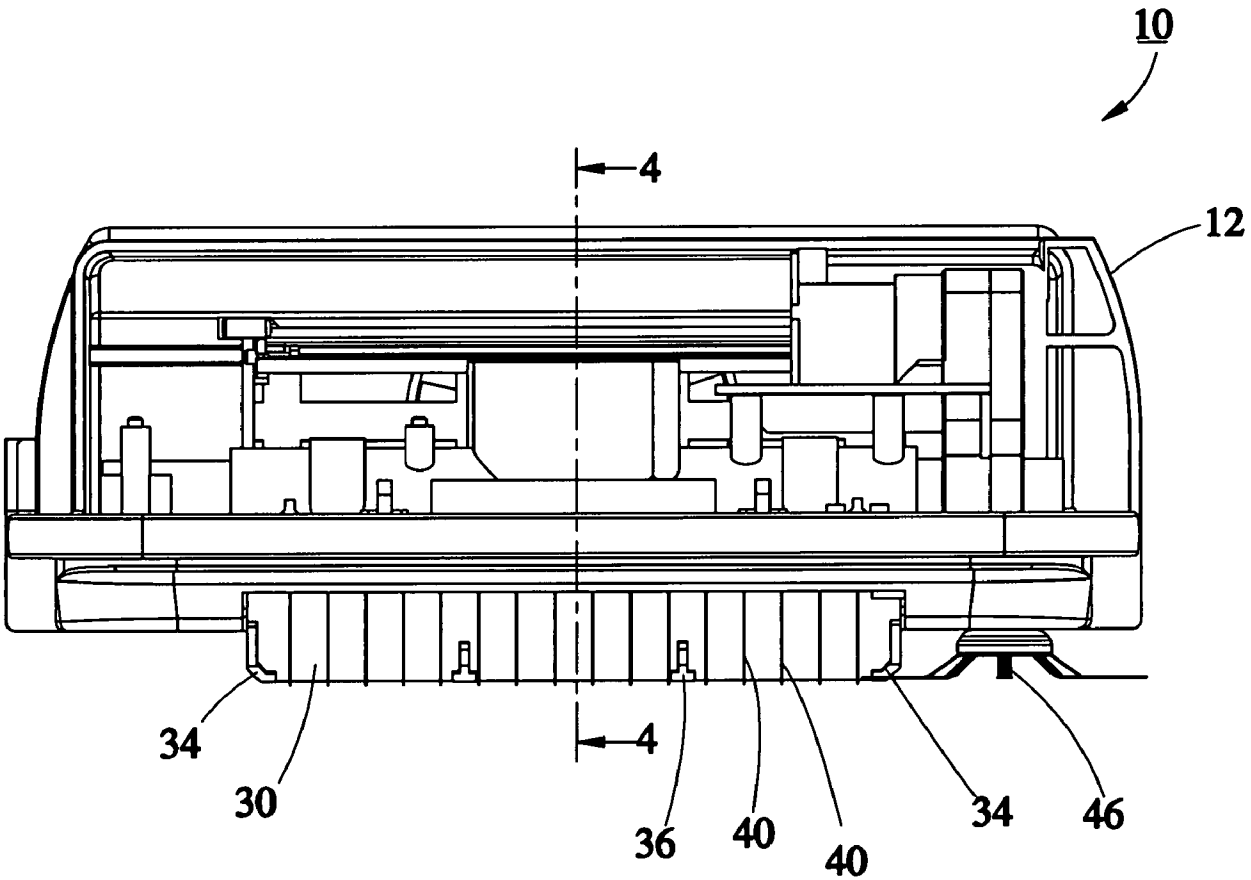
FIG. 2 is a front view of the preferred embodiment of the present invention.
Figure 3:
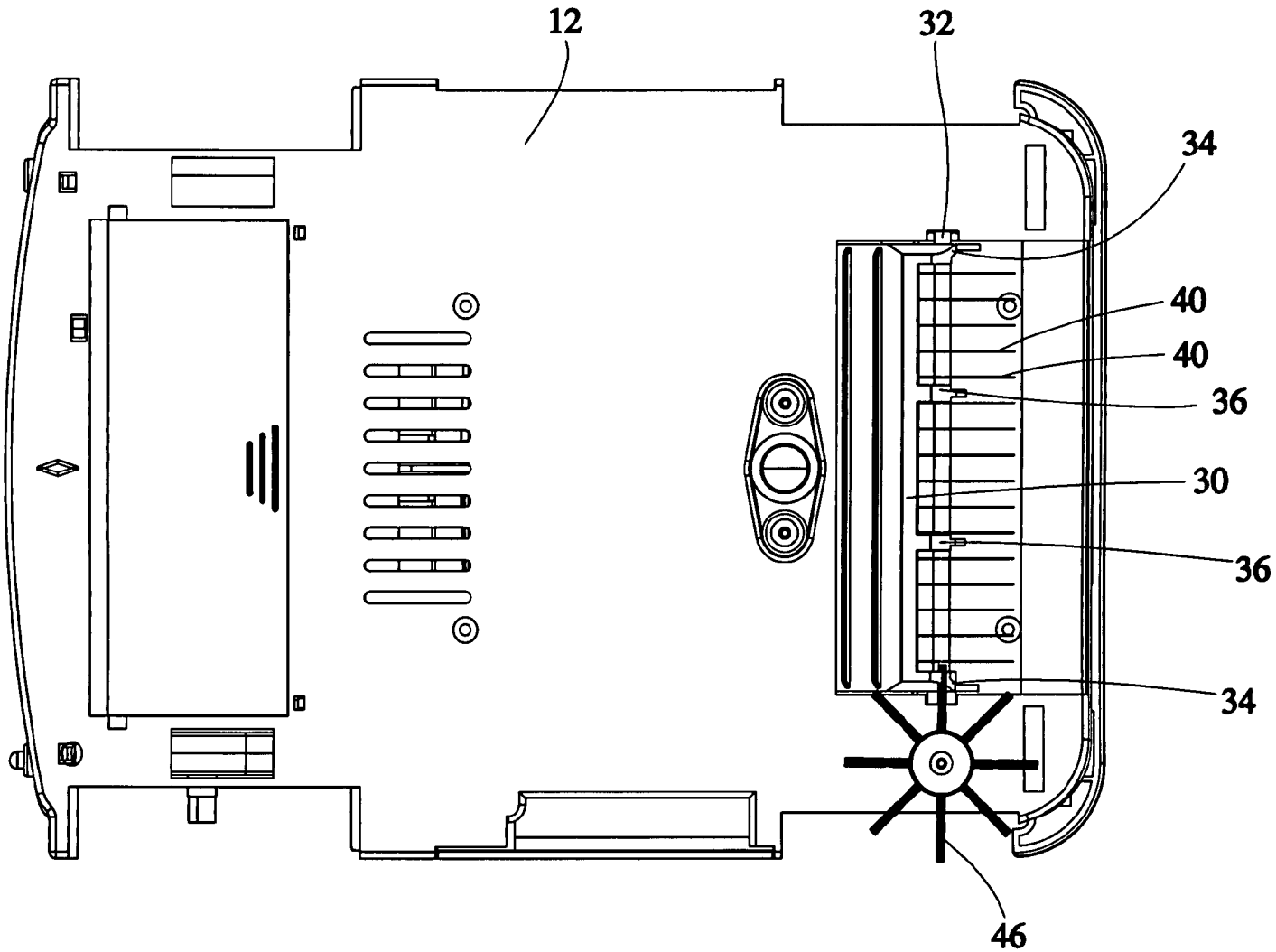
FIG. 3 is a bottom view of the preferred embodiment of the present invention.
Figure 4:
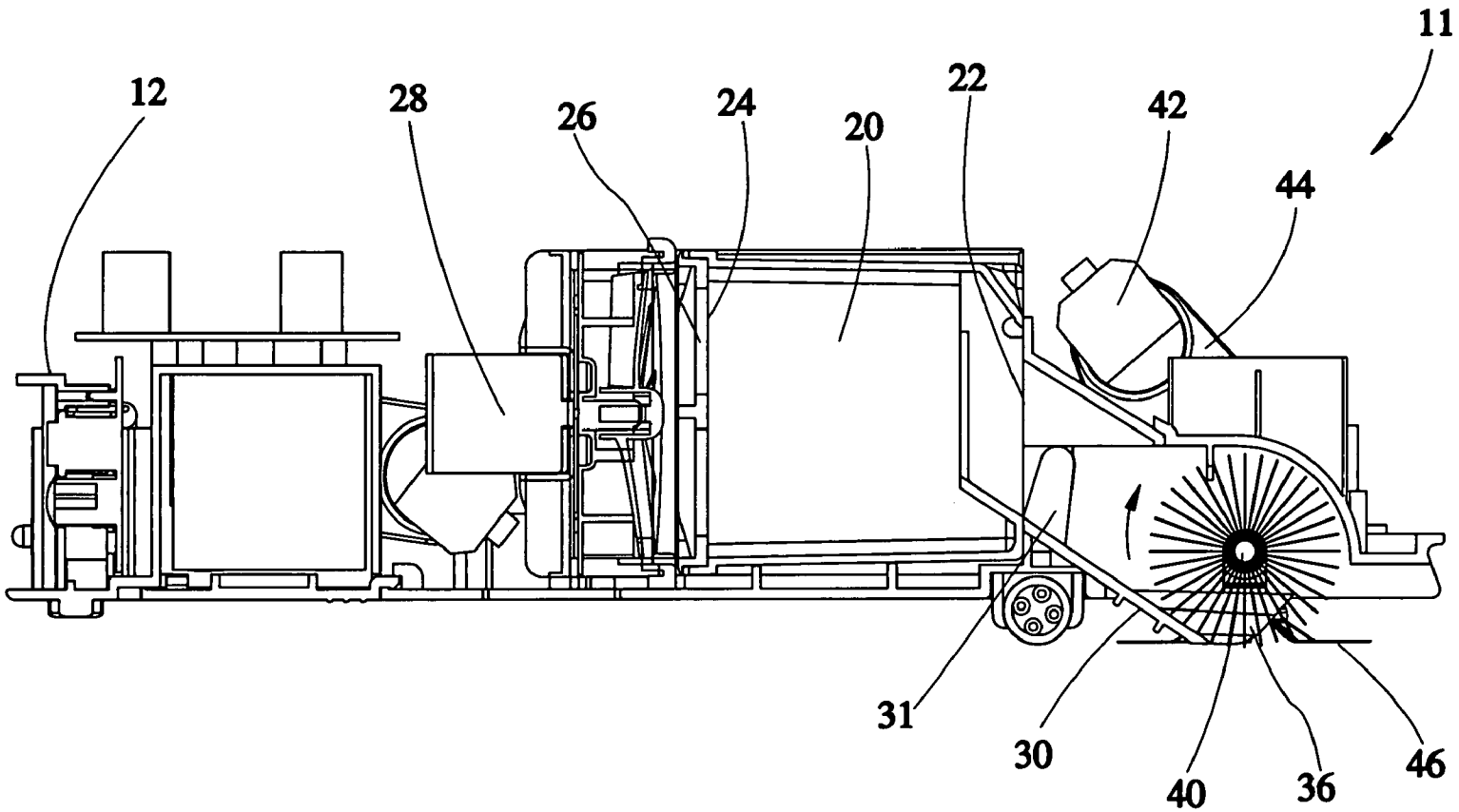
FIG. 4 is a sectional view taken from a line 4-4 indicated in FIG. 2.
Figure 5:
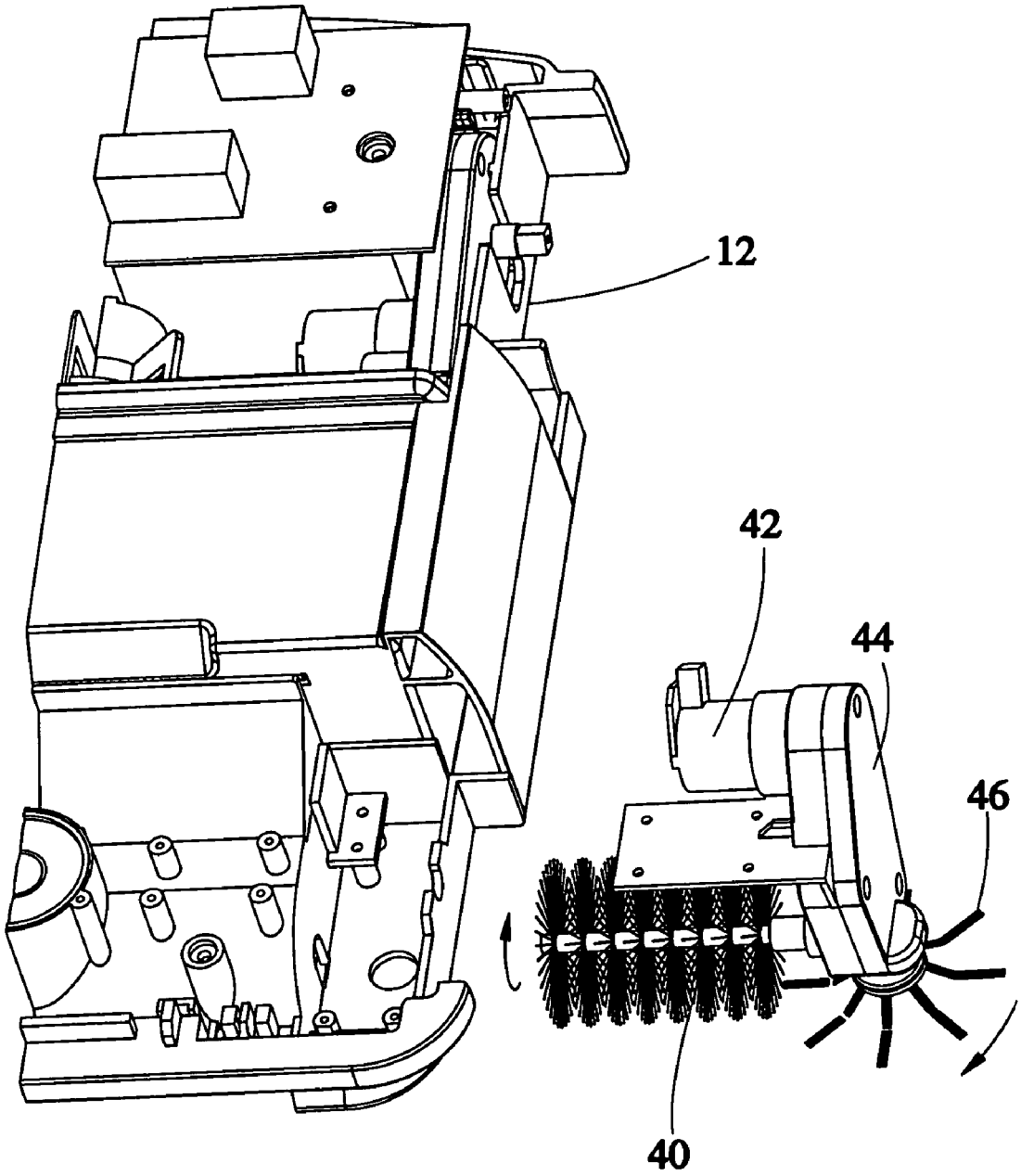
FIG. 5 is an exploded view of a part of the preferred embodiment of the present invention.
Figure 6:
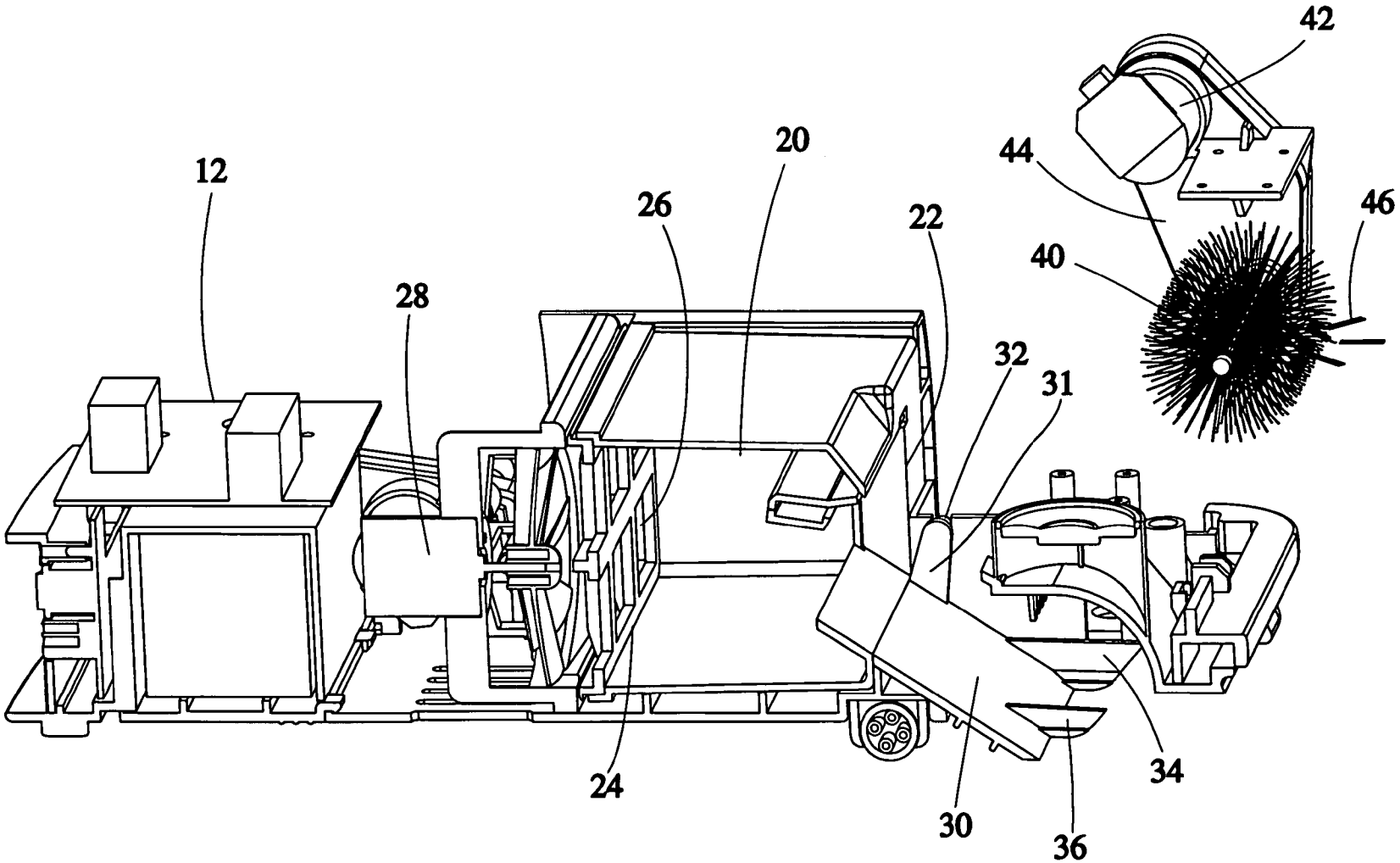
FIG. 6 is another exploded view of a part of the preferred embodiment of the present invention.
Figure 7:
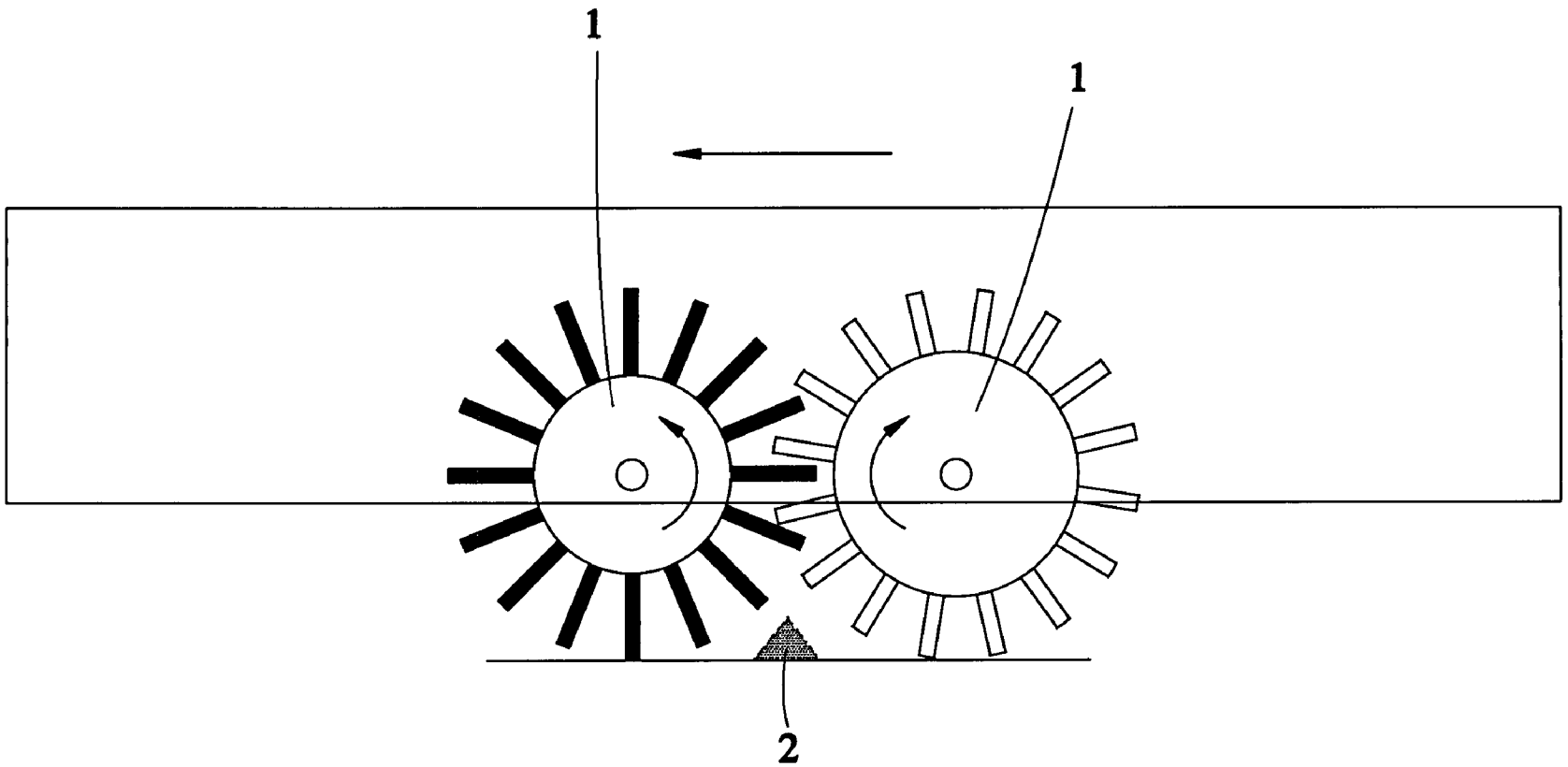
FIG. 7 is a schematic view of the round brushes of the conventional antonymous floor-cleaning robot at work.

Referring to FIGS. 1-6, a dust-collectable mobile robotic vacuum cleaner 10 is composed of a base frame 12, a driving device 13, a control device 14, a collision-detectable unit 15, and a dust-collecting device 11. The driving device 13 is mounted to the base frame 12 for driving the movement of the base frame 12. The control device 14 is mounted to the base frame 12 and connected with the driving device 13 for controlling the moving direction of the driving device. The collision-detectable unit 15 is mounted to the base frame 12 and electrically connected with the control device 14 for detecting whether the base frame 12 in motion encounters a barrier and for generating and transmitting a signal to the control device 14 while encountering the barrier. The dust-collecting device 11 includes a dust-collecting box 20, a dust guider 30, and a round brush 40, a motor 42 for driving the round brush 40, a transmission 44 connected with the motor 42, and a side brush 46 connected with the transmission 44.

The dust-collecting box 20 is mounted inside the base frame 12, having a dust entrance 22 formed at one side thereof, an exhaust port 24 formed at the other side thereof, a dust-collecting plate 26 mounted to the dust-collecting box 20, a plurality of meshes formed on the dust-collecting plate 26 and covering the exhaust port 24 for ventilation, and an exhaust blower 28 mounted to the dust-collecting box 20 and corresponding to the exhaust port 24 and located outside the dust-collecting box 20 for pumping the air out of the dust-collecting box 20.

The dust guider 30 includes two pivot pins 32, two bevels 34, two guiding portions 36, and two convexities 31, having one side lying against a lower edge of the dust entrance 22. The two convexities 31 extend upward from two opposite sides of a top section of the dust-collecting plate 30 respectively. The two pivot pins 32 is mounted into the two convexities 31 respectively, thus enabling the opposite side of the dust-collecting plate 30 to pivot upward and downward on the pivot pins 32. The opposite side of the dust-collecting plate 30 extends downward at a predetermined angle to lie against the ground. The two bevels 34 extend slopingly upward from bilateral edges of a bottom section of the dust-collecting plate 30 respectively. The two guiding portions 36 each extend outward along the ground from the bottom section the dust guider 30 and each have an arc-shaped end formed at a distal end thereof, equidistantly located between the two bevels 34 and on a top side of the dust guider 30.

The round brush 40 is mounted inside the base frame 12. The motor 42 is electrically connected with the driving device 13 to enable the transmission 44 to drive rotation of the round and side brushes 40 and 46. The round brush 40 is inwardly rotatably located at the bottom section of the dust guider 20. The side brush 46 is horizontally rotatably located at one side of the base frame 12.

When the base frame 12 is moved for operation, the side brush 46 horizontally rotatably sweeps the dust particles located beside the base frame 12 to the round brush 40, and the round brush 40 lies against the ground inwardly rotatably sweeps the dust particles onto the dust guider 30. In the meantime, the exhaust blower 28 pumps the air out of the dust-collecting box 20 to generate a negative pressure inside the dust-collecting box 20 and to generate an air attraction at the dust entrance, thus sucking the dust particles located on and over the top side of the dust guider 39 into the dust-collecting box 20. The meshes of the dust-collecting plate 26 can block the dust particles and enable the air pumped out of the dust-collecting box 20 to exhaust outside to further keep the dust particles inside the dust-collecting box 20. In addition, when the base frame 12 turns and then the dust guider 30 encounters a barrier, e.g. a protrusion (not shown) in uneven ground, the bevels 34 can slidably move through the upper side of the barrier to enable the dust guider 30 to pivot upward on the pivot pin 32 to move across the barrier. When the base frame 12 marches forward and then the dust guider 30 encounters the barrier, the guiding portions 36 slidably move through the upper side of the barrier to enable the dust guider 30 to pivot upward to move across the barrier.

In conclusion, the present invention employs the cooperation of the round brush and the dust guider to eliminate the problem that the prior art fails to clean the dust particles at the dead angle to enhance the cleaning potency. In addition, the guiding portions and the bevels in cooperation with the upward and downward pivoting movement of the dust guider can enable the robotic vacuum cleaner of the present invention to move across the barrier and continue cleaning the dust. Accordingly, the present invention includes advantages of effective cleaning potency.

What is claimed is:

1. A dust-collectable mobile robotic vacuum cleaner comprising:

a base frame;

a driving device mounted to said base frame for generating driving power;

a control device mounted to said base frame and electrically connected with said driving device for controlling said driving device and the moving direction of said base frame a collision-detectable unit mounted to said base frame and electrically connected with said control device for generating a signal while said base frame in motion encounters a barrier; and a dust-collecting device mounted to said base frame for collecting dust particles on the ground and having a dust-collecting box, a dust guider, and a round brush, said dust-collecting box having a dust entrance formed at a front side thereof, said dust guider having a front side and a rear side, the rear side is pivotably mounted to said dust-collecting box and located at a lower edge of said dust entrance, and the front side extends downward at a predetermined angle to lie against the ground, wherein said dust guider is pivotably mounted to said dust-collecting box to guide the dust particles into said dust entrance, said round brush being mounted inside said base frame and rotatably located in proximity to the front side of said dust guider for sweep the dust particles onto the dust guider.

2. The dust-collectable mobile robotic vacuum cleaner as defined in claim 1, wherein said dust guider further comprises two bevels extending slopingly upward from left and right edges of a front side thereof respectively.

3. The dust-collectable mobile robotic vacuum cleaner as defined in claim 1, wherein said dust guider further comprises at least one guiding portion located at a front end thereof for guiding said dust guider to pivot upward and downward with respect to said dust guider to move across the barrier while encountering the barrier.

4. The dust-collectable mobile robotic vacuum cleaner as defined in claim 1, wherein said dust-collecting device further comprises a side brush mounted to one of left and right sides of said base frame for horizontally rotatably sweeping the dust particles toward said round brush.

5. The dust-collectable mobile robotic vacuum cleaner as defined in claim 1, wherein said dust-collecting device further comprises an exhaust blower fixed outside said dust-collecting box and a pumping port formed at a rear side of said dust-collecting box, said exhaust blower corresponding to said pumping port for pumping the air out of said dust-collecting box and generating negative pressure inside said dust-collecting box.

6. The dust-collectable mobile robotic vacuum cleaner as defined in claim 1 or 5, wherein said dust-collecting device further comprises a motor for driving rotation of said round brush or said side brush.

7. The dust-collectable mobile robotic vacuum cleaner as defined in claim 5, wherein said dust-collecting device further comprises a ventilative dust-collecting plate mounted to said dust-collecting box and located at said pumping port for blocking the dust particles.

* * * * *